US005535448A

United States Patent [19]

Williamson et al.

[11] Patent Number: 5,535,448

[45] Date of Patent: Jul. 16, 1996

[54] LEG ORNAMENTATION DEVICE

[76] Inventors: Penny Williamson, Rt. W Box 577F; Michael Williamson, Rte. 1 Box 577F, both of Cana, Va. 24317

[21] Appl. No.: 435,994

[22] Filed: May 5, 1995

[51] Int. Cl.[6] ..... A41D 27/08; A41D 17/02; D04D 7/00

[52] U.S. Cl. ..... 2/22; 2/311; 2/312; 2/313; 2/314; 2/315; 2/338; 2/1; 63/2

[58] Field of Search ..... 2/22, 1, 69, 22, 2/23, 24, 312, 313, 314, 315, 316, 317, 318, 319, 320, 321, 304, 308, 240; 63/2, 3

[56] References Cited

U.S. PATENT DOCUMENTS

| | | | |
|---|---|---|---|
| 1,019,541 | 3/1912 | Sinclair | 2/314 |
| 1,510,398 | 9/1924 | Grandle | 2/314 |
| 1,584,476 | 5/1926 | Schalow | 2/308 |
| 2,148,514 | 1/1939 | Kennedy | 2/308 |
| 2,271,490 | 1/1942 | Pons Y Valdes | 2/313 |
| 2,650,590 | 9/1953 | Moore et al. | 63/3 |
| 4,121,360 | 10/1978 | Vlerebome | 63/2 X |
| 4,975,986 | 12/1990 | Strongwater | 2/244 X |
| 5,115,519 | 5/1992 | Dalrymple | 2/247 X |
| 5,136,726 | 8/1992 | Kellin et al. | 2/244 X |
| 5,308,671 | 5/1994 | Wells | 2/300 X |
| 5,386,710 | 2/1995 | Moore | 63/2 |

*Primary Examiner*—Jeanette E. Chapman

[57] ABSTRACT

A leg ornamentation device including an upper strap adapted to form an upper loop when worn by a user. Three upper male fasteners on the front face of the upper strap are capable of securing the upper loop around the leg below the knee by coupling with an upper female fastener on the rear face of the upper strap adjacent the second edge of the upper strap. A lower strap adapted to form a lower loop when worn by a user. Three lower male fasteners on the front face of the lower strap are capable of securing the lower loop around an ankle of the leg by coupling with a lower female fastener on the rear face of the lower strap adjacent the second edge of the lower strap. A vertical connecting strap that extends between the upper and lower strap and has a top looped portion capable of receipt therethrough the upper strap and a bottom looped portion capable of receipt therethrough the lower strap and a middle portion therebetween.

1 Claim, 4 Drawing Sheets

FIG. 3
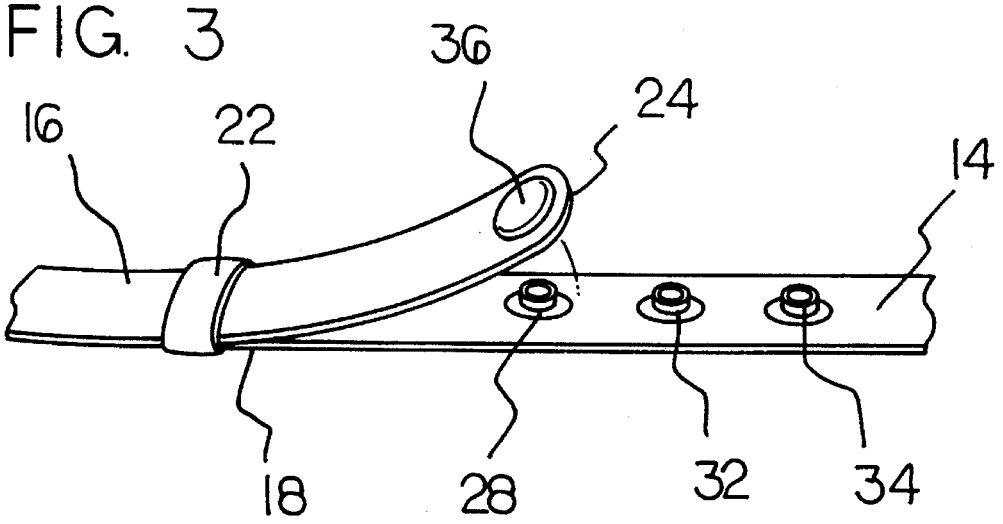
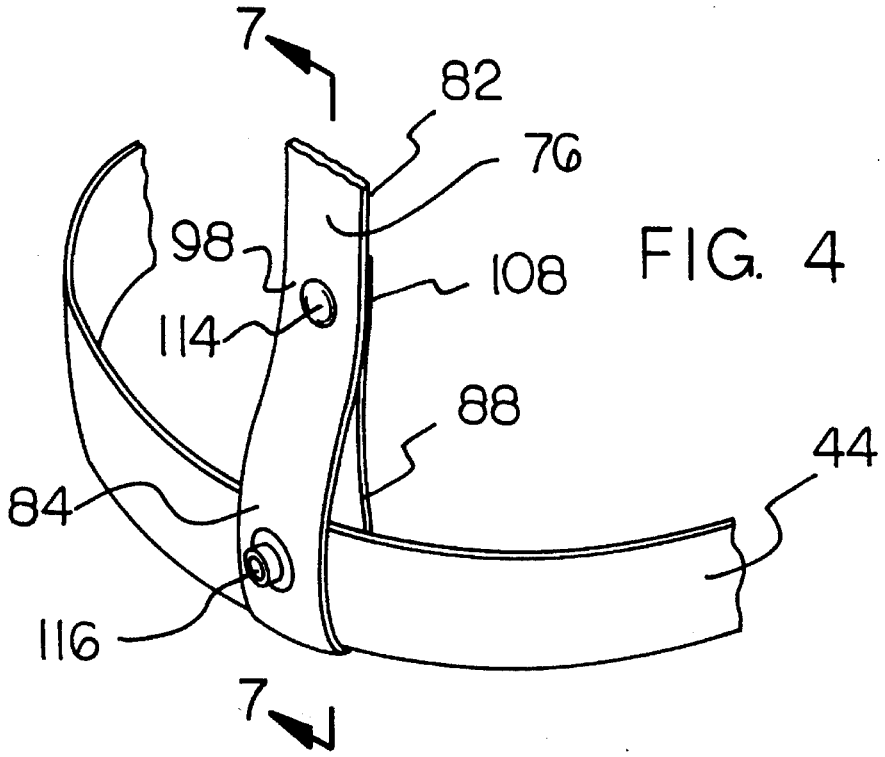
FIG. 4

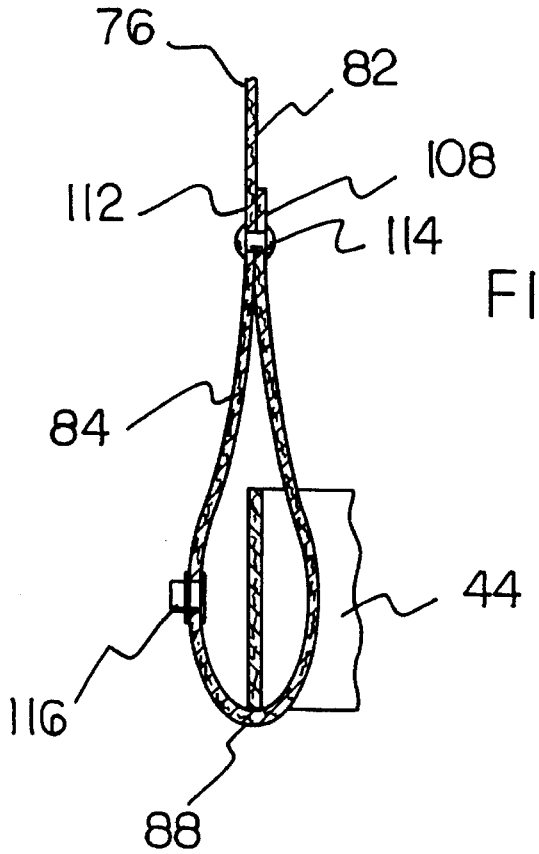
FIG. 7
FIG. 8
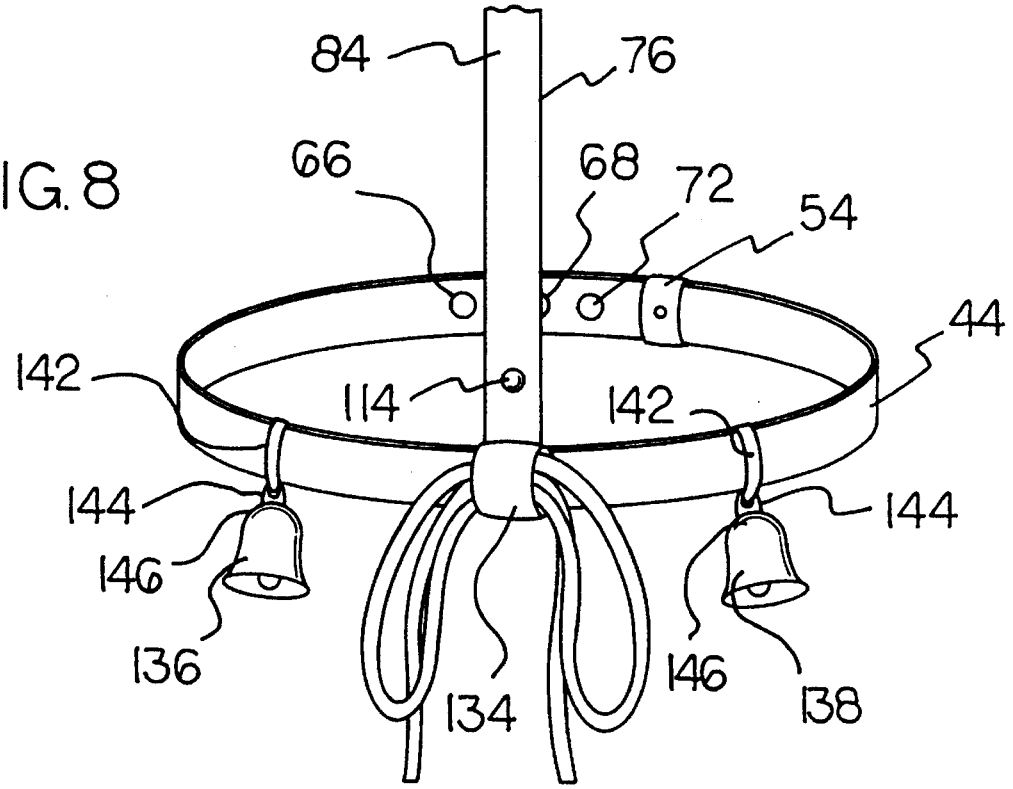

LEG ORNAMENTATION DEVICE

BACKGROUND OF THE INVENTION

1. Field of the Invention

The present invention relates to a leg ornamentation device for enhancing the visual appeal of a human leg and for wearing on a bare leg or over a covered leg to improve the legs appearance through the integration of the leg ornamentation device.

2. Description of the Prior Art

The use of leg jewelry is known in the prior art. More specifically, leg jewelry heretofore devised and utilized for the purpose of ornamentation are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,555,635 to Swierenga discloses a garter. U.S. Pat. No. 4,393,522 to Clabrese discloses a ankle garter with foot stirrup. U.S. Pat. No. 4,502,158 to Mouri, Uemura and Koryo-cho discloses a slip down-free socks with a garter. U.S. Pat. No. 4,788,722 to Oliver discloses a fabric fashion accessory. Lastly, U.S. Pat. No. Des. 335,102 to Crowder and Worchester discloses a leg ring.

While these devices fulfill their respective, particular objectives and requirements, the aforementioned patents do not describe a leg ornamentation device that is visually enhancing and has three straps of varying sizes for placement over three positions on a human leg.

In this respect, the leg ornamentation device according to the present invention substantially departs from the conventional concepts and designs of the prior art, and in doing so provides an apparatus primarily developed for the purpose of a leg ornamentation device for enhancing the visual appeal of a human leg and for wearing on a bare leg or over a covered leg to improve the legs appearance through the integration of the leg ornamentation device.

Therefore, it can be appreciated that there exists a continuing need for a new and improved leg ornamentation device for enhancing the visual appeal of a human leg and for wearing on a bare leg or over a covered leg to improve the legs appearance through the integration of the leg ornamentation device. In this regard, the present invention substantially fulfills this need.

SUMMARY OF THE INVENTION

In view of the foregoing disadvantages inherent in the known types of leg jewelry now present in the prior art, the present invention provides an improved leg ornamentation device. As such, the general purpose of the present invention, which will be described subsequently in greater detail, is to provide a new and improved leg ornamentation device and method which has all the advantages of the prior art and none of the disadvantages.

To attain this, the present invention essentially comprises in combination an upper strap formed in a rectangular configuration when resting in a planar configuration. The upper strap has a front face, a rear face, a first end edge with a D-ring integral thereto, a second end edge and an intermediate portion therebetween. The upper strap has a width of about ½ inch and a length of about between 1 to 2 feet. The upper strap is flexible and essentially inextensible and adapted to form an upper loop when worn by a user. Three upper male fasteners are included on the front face of the upper strap linearly spaced from the D-ring of the upper strap. A upper female fastener is included on the rear face of the upper strap adjacent the second end edge of the upper strap. The strap is adapted to be formed into a cylindrical configuration when the second end edge of the upper strap passes through the D-ring to overlap the front face. Coupling between the upper female fastener with one of the upper male fasteners occurs for releasable coupling therebetween. The upper strap is resilient in its circumference when formed into the upper loop and capable of being securely positioned around a leg just below the knee with the coupling of the upper fasteners. A lower strap formed in a rectangular configuration when resting in a planar configuration is provided. The lower strap has a front face, a rear face, a first end edge with a D-ring integral thereto, a second end edge and an intermediate portion therebetween. The lower strap has a width of about ½ inch and a length of about between 5 inches to 18 inches. The lower strap is flexible and essentially inextensible and adapted to form a lower loop when worn by a user. Three lower male fasteners on the front face of the lower strap linearly spaced from the D-ring of the lower strap is included. A lower female fastener on the rear face of the lower strap adjacent the second end edge is provided. The lower strap is adapted to be formed into a cylindrical configuration when the second end edge of the lower strap passes through the D-ring to overlap the front face. Coupling between the lower female fastener with one of the lower male fasteners occurs for releasable coupling therebetween. The lower strap is resilient in its circumference when formed into the lower loop and capable of being securely positioned around an ankle of the leg with the coupling of the lower fasteners. A vertical connecting strap is included. The vertical connecting strap is formed in a rectangular configuration having an interior face, an exterior face, a top looped portion and a bottom looped portion with a middle portion therebetween. The middle portion has an upper area and a lower area. The vertical connecting strap has a top end edge. The top looped portion is formed by coupling the top end edge to the upper area of the middle portion with a top rivet. The top looped portion has a top male fastener on the exterior face and is capable of receipt of the upper strap therethrough. The vertical connecting strap further has a bottom end edge. The bottom looped portion is formed by coupling the bottom end edge to the lower area with a bottom rivet. The bottom looped portion has a bottom male fastener on the exterior face and capable of receipt of the lower strap therethrough. The middle portion has three buttons centrally positioned thereon. the vertical strap has a width of about ½ inch and a length of about 10 to 15 inches. The vertical connecting strap extending between the upper strap and the lower strap is positionable over a shin of the leg. Also included are a first pair of replaceable decorative attachments supportable by the top and bottom male fasteners on the exterior face along the top and bottom looped portion. The first pair of decorative attachments are a pair of bows formed of a flexible material. Lastly, a second pair of replaceable decorative attachments are included. The second pair of decorative attachments are supportable by the lower strap. The second pair of decorative attachments are a pair of bells with each having a hanging loop for attaching to an eyelet along an upper portion of the bell. The hanging loop of the bells are capable of receiving the lower strap therein.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved leg ornamentation device which has all of the advantages of the prior art leg jewelry and none of the disadvantages.

It is another object of the present invention to provide a new and improved leg ornamentation device which may be easily and efficiently manufactured and marketed.

It is further object of the present invention to provide a new and improved leg ornamentation device which is of durable and reliable constructions.

An even further object of the present invention is to provide a new and improved leg ornamentation device which is susceptible of a low cost of manufacture with regard to both materials and labor, and which accordingly is then susceptible of low prices of sale to the consuming public, thereby making such leg ornamentation device economically available to the buying public.

Still yet another object of the present invention is to provide a new and improved leg ornamentation device which provides in the apparatuses and methods of the prior art some of the advantages thereof, while simultaneously overcoming some of the disadvantages normally associated therewith.

Even still another object of the present invention is to provide a new and improved leg ornamentation device for enhancing the visual appeal of a human leg and for wearing on a bare leg or over a covered leg to improve the legs appearance through the integration of the leg ornamentation device.

Lastly, it is an object of the present invention to provide a new and improved leg ornamentation device comprising an upper strap adapted to form an upper loop when worn by a user having a front face, a rear face, a first end edge with a D-ring, a second edge and in intermediate portion therebetween. Three upper male fasteners on the front face of the upper strap are capable of securing the upper loop around the leg below the knee by coupling with an upper female fastener on the rear face of the upper strap adjacent the second edge of the upper strap. A lower strap is adapted to form a lower loop when worn by a user having a front face, a rear face, a first end edge with a D-ring, a second edge and in intermediate portion therebetween. Three lower male fasteners on the front face of the lower strap capable of securing the lower loop around an ankle of the leg by coupling with a lower female fastener on the rear face of the lower strap adjacent the second edge of the lower strap. A vertical connecting strap extends between the upper and lower strap having a top looped portion capable of receipt therethrough the upper strap and a bottom looped portion capable of receipt therethrough the lower strap and a middle portion therebetween.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an enlarged view of the fastener assembly of enclosure 3 of FIG. 2 of the present invention.

FIG. 4 is an enlarged fragmentary view of decoration attachment portion of the present invention.

FIG. 7 is a cross sectional view of FIG. 6, of the present invention, along line 7—7.

FIG. 8 is a sectional elevational view of the lower strap with decorations.

The same reference numerals refer to the same parts through the various Figures.

DESCRIPTION OF THE PREFERRED EMBODIMENT

Figure 1:
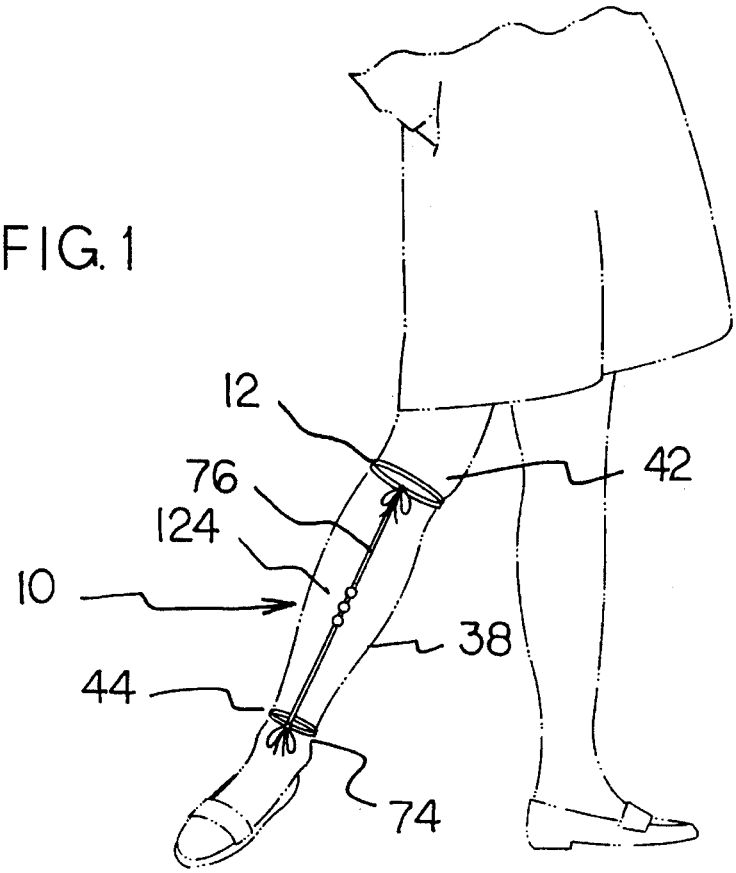
FIG. 1 is a perspective view of the preferred embodiment of the leg ornamentation device constructed in accordance with the principles of the present invention.

With reference now to the drawings, and in particular to FIG. 1 thereof, the preferred embodiment of the new and improved leg ornamentation device embodying the principles and concepts of the present invention and generally designated by the reference numeral 10 will be described.

The present invention, the leg ornamentation device 10 is comprised of a plurality of components. Such components in their broadest context include an upper strap, a lower strap, a plurality of male fasteners, a plurality of female fasteners, a vertical strap and decorative attachments. Such components are individually configured and correlated with respect to each other so as to attain the desired objective.

Figure 2:
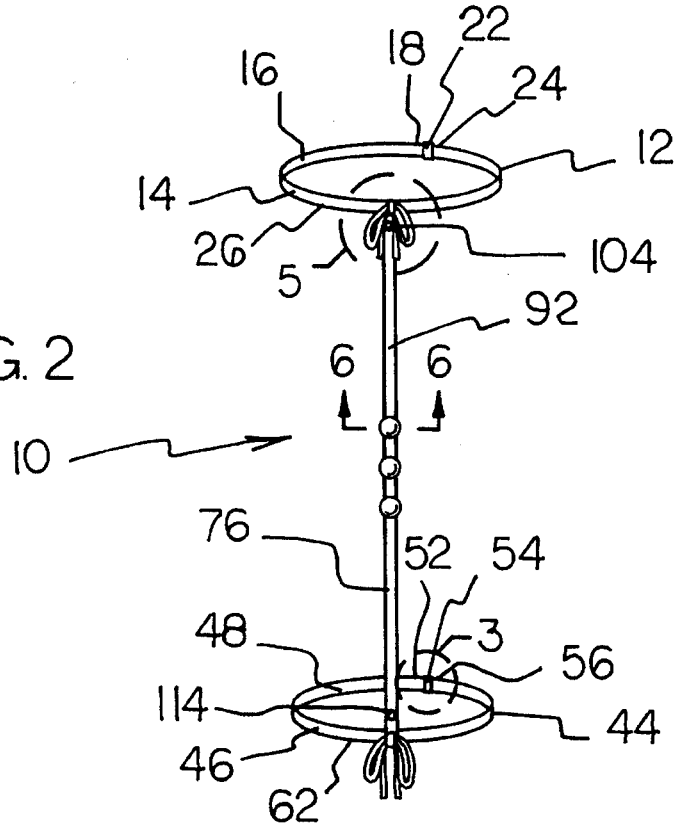
FIG. 2 is a front elevational view of the present invention in an operable configuration.

Specifically, the present invention includes an upper strap 12 formed in a rectangular configuration when resting in a planar configuration having a front face 14, a rear face 16, a first end edge 18 with a D-ring 22 integral thereto, a second end edge 24 and an intermediate portion 26 therebetween as shown in FIG. 2. The upper strap has a width of about ½ inch and a length of about between 1 to 2 feet, the upper strap 12 being flexible and essentially inextensible and adapted to form an upper loop 12 when worn by a user. The upper strap is formed of any durable and washable fabric such as cotton or satin.

Also included are three upper male fasteners 28, 32 and 34 on the front face of the upper strap linearly spaced from the D-ring 22 of the upper strap 12 as shown in FIG. 3. An upper female fastener 36 is included on the rear face of the upper strap adjacent the second end edge of the upper strap as shown in FIG. 3. The upper strap is adapted to be formed into a cylindrical configuration when the second end edge 24 of the upper strap passes through the D-ring 22 to overlap the front face 14 for coupling between the upper female fastener 38 and one of the upper male fasteners. The fasteners are for releasable coupling together. The upper strap is resilient in its circumference when formed into the upper loop. The upper strap is capable of being securely positioned around a leg 38 just below a knee 42 with the coupling of the upper fasteners as shown in FIG. 1. The fasteners of the upper strap are snap type fasteners formed of plastic or metal.

Further included is a lower strap 44 formed in a rectangular configuration when resting in a planar configuration having a front face 46, a rear face 48, a first end edge 52 with a D-ring 54 integral thereto, a second end edge 56 and an intermediate portion 62 therebetween. As best illustrated in FIG. 2, the lower strap has a width of about ½ inch and a length of about between 5 to 18 inches. The lower strap being flexible and essentially inextensible and adapted to form a lower loop when worn by a user. The lower strap is formed of any durable and washable fabric such as cotton or satin.

Three lower male fasteners 66, 68, and 72 are included on the front face 46 of the lower strap 44 linearly spaced from the D-ring 54 of the lower strap as shown in FIG. 8. A lower female fastener 74 is included on the rear face 48 of the lower strap adjacent the second end edge 56. The fasteners of the lower strap are exactly like the fasteners of the upper strap. FIG. 3 depicts the upper fasteners in an operative manner and the lower fasteners operate in the same fashion. The lower strap 44 is adapted to be formed into a cylindrical configuration when the second end edge of the lower strap passes through the D-ring 54 to overlap the front face for coupling of the lower female fastener with one of the lower male fasteners. The coupling of the lower fasteners is releasable coupling. The lower strap is resilient in its circumference when formed into the lower loop and is capable of being secured around an ankle 74 of the leg 38 with the coupling of the lower fasteners. The fasteners of the lower strap are snap type fasteners formed of plastic or metal.

Figure 5:
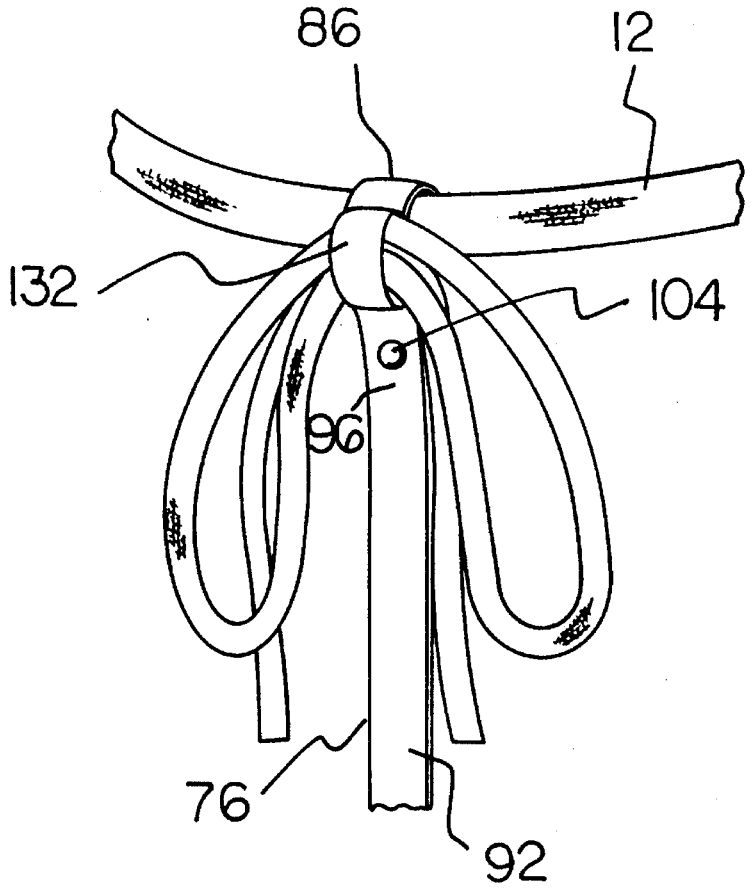
FIG. 5 is an enlarged view of the attachment at enclosure 5 of FIG. 2.

Positioned between the upper strap and the lower strap is a vertical connecting strap 76 as shown in FIGS. 1 and 2. The vertical connecting strap is formed in a rectangular configuration having an interior face 82, an exterior face 84, a top looped portion 86 and a bottom looped portion 88 with a middle portion 92 therebetween. The middle portion has an upper area 96 and a lower area 98. The vertical connecting strap has a top end edge 102. The top looped portion is formed by coupling the top end edge to the upper area of the middle portion with a top rivet 104. The top looped portion has a top male fastener 106 on the exterior face and is capable of receiving the upper strap 12 therethrough as shown in FIG. 5. The vertical connecting strap 76 further has a bottom end edge 108.

As best illustrated in FIG. 4, the bottom looped portion is formed by coupling the bottom end edge 108 to the lower area 98 of the middle portion with a bottom rivet 114. The formation of the top looped portion is identical to the formation of the bottom looped portion illustrated in FIG. 4. The bottom looped portion has a bottom male fastener 116 on the exterior face and is capable of receiving the lower strap 44 therethrough as shown in FIG. 8. The middle portion has three buttons 120 centrally positioned thereon.

Figure 6:
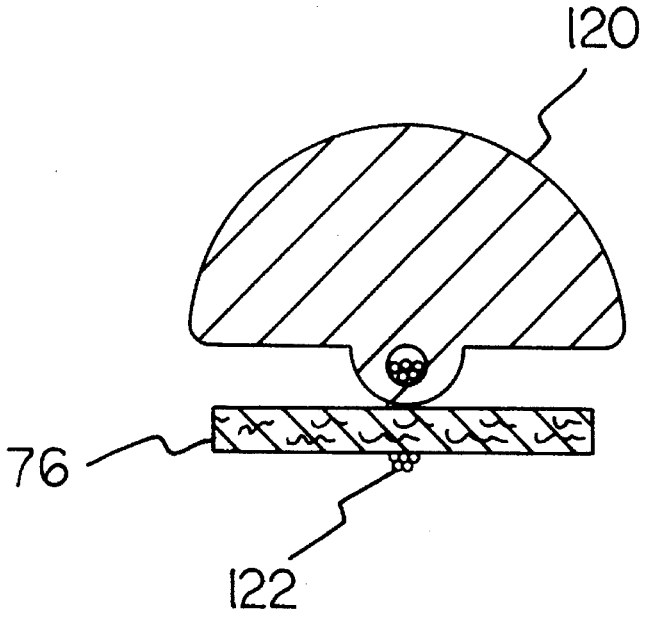
FIG. 6 is an enlarged sectional view of button of FIG. 2 along line 6—6.

FIG. 6 illustrates the manner in which the buttons are attached to the vertical connecting strap. In this instance the buttons are sewn on with thread 122. The vertical strap has a width of about ½ inch and a length of about 10 to 15 inches. The vertical connecting strap extends between the upper strap 12 and the lower strap 44. The vertical connecting strap is positionable over a shin 124 of the leg 38. The vertical strap is formed of a washable durable fabric such as cotton or satin. The fasteners of the vertical connecting strap are formed of plastic or metal. FIG. 7 is a cross sectional view of the bottom looped portion 88 of the vertical strap showing the bottom rivet 114 and bottom male fastener 116 passing through the fabric.

Also included is a first pair of replaceable decorative attachments 132 and 134 supportable by the top 104 and bottom 116 male fasteners on the exterior face along the top 86 and bottom 88 looped portion as shown in FIGS. 1 and 2. The first pair of decorative attachments being a pair of bows 132 and 134 formed of a flexible material. The bows shown in FIG. 5 and FIG. 8 may be made of any fabric, they are preferably lace.

Lastly, a second pair of replaceable decorative attachments 136 and 138 supportable by the lower strap 44 are included. The second pair of decorative attachments being a pair of bells 136 and 138 as shown in FIG. 8. Each bell has a hanging loop 142 for attaching to an eyelet 144 along an upper portion 146 of the bell. The hanging loops of the bells are capable of receiving the lower strap therein.

The present invention is a leg ornamentation device that has upper and lower straps for positioning around different ends of the same leg of a human. This requires that the straps differ in length. The upper and lower straps have a connecting strap perpendicular thereto. The connecting strap has a loop for the upper strap to pass through and a loop for the lower strap to pass through. Snap fasteners are used on the upper and lower straps to secure them around the leg. Additionally, snap fasteners are used on the loops of the connecting strap. Snap fasteners were chosen because of their durability. The bracelet may be decorated with a variety of detachable ornaments. The applicant has included but is not limited to buttons, bows and bells. The leg ornamentation device may be worn with most outfits whether they be casual, lounging or formal wear.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved leg ornamentation device comprising, in combination:

an upper strap formed in a rectangular configuration when resting in a planar configuration having a front face, a rear face, a first end edge with a D-ring integral thereto, a second end edge and an intermediate portion therebetween, the upper strap having a width of about ½ inch and a length of about between 1 to 2 feet for positioning just below the knee of a wearer, the upper strap being flexible and essentially inextensible and adapted to form an upper loop when worn by a user;

three upper male fasteners on the front face of the upper strap linearly spaced from the D-ring of the upper strap and an upper female fastener on the rear face of the upper strap adjacent the second end edge of the upper strap, the upper strap being adapted to be formed into a cylindrical configuration, the cylindrical configuration being formed when the second end edge of the upper strap passes through the D-ring overlapping the front face and allows releasable coupling between the upper female fastener and one of the upper male fasteners of the upper strap, the upper strap being resilient in its circumference when formed into the upper loop and capable of being securely positioned around a leg just below a knee with the coupling of the upper fasteners;

a lower strap formed in a rectangular configuration when resting in a planar configuration having a front face, a rear face, a first end edge with a D-ring integral thereto, a second end edge and an intermediate portion therebetween, the lower strap having a width of about ½ inch and a length of about between 5 inches to 18 inches for positioning around an ankle of the leg having the upper strap therearound, the lower strap being flexible and essentially inextensible and adapted to form a lower loop when worn by a user;

three lower male fasteners on the front face of the lower strap linearly spaced from the D-ring of the lower strap and a lower female fastener on the rear face of the lower strap adjacent the second end edge, the lower strap being adapted to be formed into a cylindrical configuration, the cylindrical configuration being formed when the second end edge of the lower strap passes through the D-ring overlapping the front face and allows releasable coupling between the lower female fastener and one of the lower male fasteners of the lower strap, the lower strap being resilient in its circumference when formed into the lower loop and capable of being securely positioned around an ankle of the leg with the coupling of the lower fasteners;

a vertical connecting strap formed in a rectangular configuration having an interior face, an exterior face, a top looped portion and a bottom looped portion with a middle portion therebetween, the middle portion having an upper area and a lower area, the vertical connecting strap having a top end edge, the top looped portion formed by coupling the top end edge to the upper area of the middle portion with a top rivet, the top looped portion having a top male fastener on the exterior face and capable of receipt of the upper strap therethrough, the vertical connecting strap further having a bottom end edge, the bottom looped portion formed by coupling the bottom end edge to the lower area with a bottom rivet, the bottom looped portion having a bottom male fastener on the exterior face and capable of receipt of the lower strap therethrough, the middle portion having three buttons sewn onto the vertical connecting strap and being centrally positioned thereon, the vertical strap having a width of about ½ inch and a length of about 10 to 15 inches, the vertical connecting strap extending between the upper strap and the lower strap being positionable over a shin of the leg in a loose fitting manner, the vertical connecting strap may be easily removed from the upper and lower straps by way of the top and bottom looped portions;

a first pair of replaceable decorative attachments supportable by the top and bottom male fasteners on the exterior face along the top and bottom looped portion, the first pair of decorative attachments being a pair of bows formed of a flexible material; and a second pair of replaceable decorative attachments supportable by the lower strap, the second pair of decorative attachments being a pair of bells with each having a hanging loop for attaching to an eyelet along an upper portion of the bell, the hanging loop of the bells capable of receipt of the lower strap therein.

* * * * *